US006413391B1

(12) United States Patent
Wilson et al.

(10) Patent No.: US 6,413,391 B1
(45) Date of Patent: Jul. 2, 2002

(54) MASKING TECHNIQUES FOR METAL PLATING

(75) Inventors: Stephen A Wilson, Blackpool; John A Billington, Preston; Peter May, Bolton, all of (GB)

(73) Assignee: BAE Systems plc, Farnborough (GB)

( * ) Notice: Subject to any disclaimer, the term of this patent is extended or adjusted under 35 U.S.C. 154(b) by 0 days.

(21) Appl. No.: 09/700,784

(22) PCT Filed: Oct. 20, 2000

(86) PCT No.: PCT/GB00/04026

§ 371 (c)(1),
(2), (4) Date: Nov. 20, 2000

(87) PCT Pub. No.: WO01/31094

PCT Pub. Date: May 3, 2001

(30) Foreign Application Priority Data

Oct. 29, 1999 (GB) ..... 9925537

(51) Int. Cl.[7] ..... C25D 17/04

(52) U.S. Cl. ..... 204/297.06; 204/297.09; 204/297.1; 204/297.14

(58) Field of Search ..... 204/279, 297.06, 204/297.09, 297.1, 297.14, 297.16

(56) References Cited

U.S. PATENT DOCUMENTS 5,006,217 A * 4/1991 Koop ..... 204/297.06
5,431,802 A 7/1995 Sukimoto et al. ..... 205/131
5,573,814 A 11/1996 Donovan ..... 427/448

FOREIGN PATENT DOCUMENTS

| | | |
|---|---|---|
| CH | 335913 | 3/1959 |
| CH | 578054 | 7/1976 |
| DE | 36 24 249 | 1/1988 |
| EP | 0 248 652 | 12/1987 |
| EP | 0 256 782 | 2/1988 |
| EP | 0 257 872 | 3/1988 |
| EP | 0 262 946 | 4/1988 |
| EP | 0 263 637 | 4/1988 |
| EP | 0 303 268 | 2/1989 |
| EP | 0 307 932 | 3/1989 |
| EP | 0 480 067 | 4/1992 |
| EP | 0 482 202 | 4/1992 |
| EP | 0 606 694 | 7/1994 |
| FR | 2 529 915 | 1/1984 |

OTHER PUBLICATIONS

Patent Abstracts of Japan, vol. 012, No. 213, Jun. 17, 1988 & JP 63 011687, Jan. 19, 1988.

* cited by examiner

*Primary Examiner*—Bruce F. Bell
(74) *Attorney, Agent, or Firm*—Nixon & Vanderhye P.C.

(57) ABSTRACT

Apparatus for metal plating an article comprising a frame having a plurality of sealing members positioned thereon, the frame being capable of conducting an electrical current between sealing members, each sealing member being adapted to be in close contact with part of an article to be located thereon, and to thereby substantially prevent fluid from touching that part of the article or entering into a bore or recess of the article, each sealing member further being adapted to conduct current between the frame and the article.

13 Claims, 3 Drawing Sheets

MASKING TECHNIQUES FOR METAL PLATING

The present invention relates to the field of metal plating of articles, and in particular to masking articles, including those having a recess or bore therein.

BACKGROUND OF THE INVENTION

In the manufacturing industry, it is often considered desirable to metal plate articles, that is to cover articles with a thin layer of metal, so that the article becomes stronger, more durable and corrosion resistant. This method of metal plating may be achieved by electro-plating for example, where an article is immersed in a metallic solution and subjected to an electric current. Such a metal plating technique generally results in the whole of the article being plated in metal, which may be undesirable, for example, where the article has a bore or a recess. Often it is desirable to coat just the outer areas of the article whilst leaving the recess or bore untreated. This is usually achieved by masking the recess or bore such that the metal is prevented from adhering to that part of the article.

A known method of masking recesses or bores is to coat the recess or bore with a non-conductive lacquer to which the metal is unable to adhere. The lacquer is generally applied to the recess or bore manually using a brush. Before the metal plating process is undertaken, the lacquer is allowed to dry and any excess lacquer is removed.

This method of masking, however, is time consuming, very labour intensive, and messy. Additionally, following the metal plating process, the lacquer must then be removed from the article by immersion in a degreaser, which uses trichloroethlene and which has health and safety implications and environmental implications due to solvent emissions.

The present invention seeks to overcome the disadvantages of the present masking method, and seeks to provide a quicker, cleaner and less labour intensive method of metal plating an article including those having a recess or bore therein.

SUMMARY OF THE INVENTION

According to the present invention there is provided a frame having a plurality of sealing members positioned thereon, the frame being capable of conducting an electrical current between sealing members, each sealing member being adapted to be in close contact with part of an article to be located thereon and to thereby substantially prevent fluid from touching that part of the article or entering into a bore or recess of the article, each sealing member further being adapted to conduct current between the frame and the article.

A force exerting device is advantageously provided on the frame for exerting the force on the article to hold the article firmly in close contact with a sealing member.

The force exerting device preferably comprises a resiliently biased member.

The sealing members may be substantially planar. Alternatively sealing members may be adapted to extend at least part way into a recess or bore of the article to be located thereon.

The frame exerting device may be adapted to hold the article between two sealing members. Alternatively the force exerting device may be adapted to hold the article between the force exerting device and a sealing member.

The sealing members may be substantially spherical or hemi-spherical. Alternatively the sealing members may be frusto-conical. The sealing members may be formed from titanium.

Alternatively the sealing members may comprise an electrically conductive core substantially encased in an electrical insulator material such as steel encased in plastic, for example. Alternatively the sealing members may be formed from a compressible, non-conductive material.

An electrically conductive member, such as a wire or spring for example, may extend from the frame through a sealing member such that the electrically conductive member is capable of forming an electrical contact between an article located on the sealing member, and the frame. The frame is preferably coated in a non-conductive material to prevent the frame from becoming metal plated when a current is applied to the frame and it is exposed to a metallic solution.

According to the present invention there is further provided a frame having a plurality of sealing members positioned thereon, the frame being capable of conducting an electrical current between sealing members, each sealing member being adapted to extend at least part way into a recess or bore of an article to be located thereon and to substantially prevent fluid from entering into the bore or recess of the article, each sealing member further being adapted to conduct current between the frame and the article.

According to the present invention in another aspect thereof, there is provided a method of metal plating an article having a bore provided therein, wherein the article is masked for plating by positioning a sealing member such that it extends through the bore and acts to seal the bore, substantially preventing plating fluid from entering therein, the sealing member being a length of foam which is compressed and passed through the bore of the article to seal the bore, a conductive wire being passed through the bore with the foam and being positioned so as to be in contact with the article, to enable a current to flow through the article during electro-plating.

The foam is preferably impermeable, and advantageously expands on heating. The foam may be expanded polyethylene cord. Preferably the foam has a diameter larger than that of the bore before compression. The foam is preferably heated before the electroplating process such that the foam expands and provides an effective seal to prevent liquid from entering the bore.

According to the present invention in another aspect thereof there is provided a method of metal plating an article wherein the article is masked for plating by positioning a sealing member such that it is in close contact with a part of the article and acts to seal off that part of the article, substantially preventing plating fluid from touching that sealed off part of the article, and wherein the article is firmly held in position against the sealing member by a force exerting device.

The sealing member may be located on a frame. Preferably the force exerting device is provided on the frame for allowing an article to be held firmly adjacent the sealing member. When the article is firmly held in the frame, at least part of the frame, and the article are exposed to a metallic solution. The frame is advantageously capable of conducting current, such that the current flows through the article held in the frame. The article is preferably dipped, whilst held in the frame, in a metallic solution. As the article is dipped in the metallic solution a current flows through the article and causes the article to become metal plated. Cadmium may be present in the solution so that the article becomes plated in cadmium.

BRIEF DESCRIPTION OF THE DRAWINGS

Several examples of the present invention will now be described by way of example only and with reference to the following drawings.

DETAILED DESCRIPTION OF THE INVENTION

Figure 1:
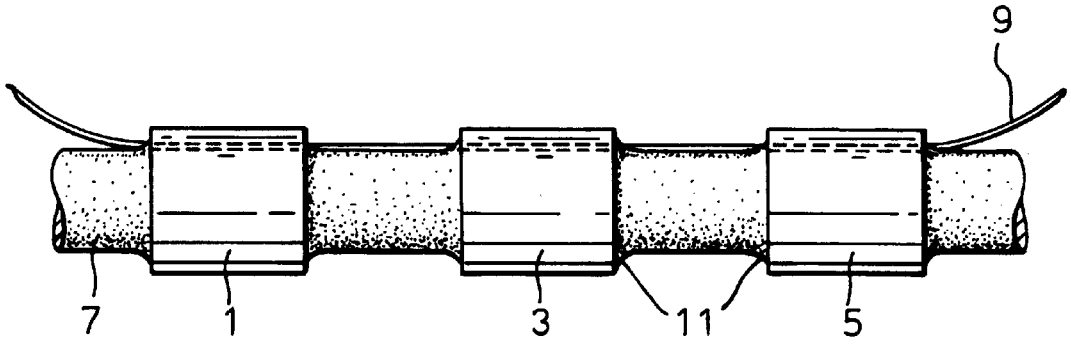
FIG. 1 shows a side elevation view of an example of the present invention.

FIG. 1 shows three bushings 1, 3, 5 threaded onto a length of foam 7, and a copper wire 9. The foam 7 is impermeable, expands on heating, and has a greater cross-sectional area than the bore of each of the bushings. The foam 7 is compressible such that it may be pushed through the bore of each bushing.

The copper wire 9 is slid through the bore of each bushing with the foam 7, so that the copper wire touches the bushing.

The foam is then heated so that it expands and provides an effective seal 11 preventing seepage of liquid into the bore of each bushing.

The bushings are then suspended in a cadmium solution from the copper wire, and a current is passed through the copper wire, causing the exposed surfaces of the bushing to become cadmium plated. The cadmium solution is prevented from entering the bore by seal 11 and so the bore does not become cadmium plated.

Figure 2:
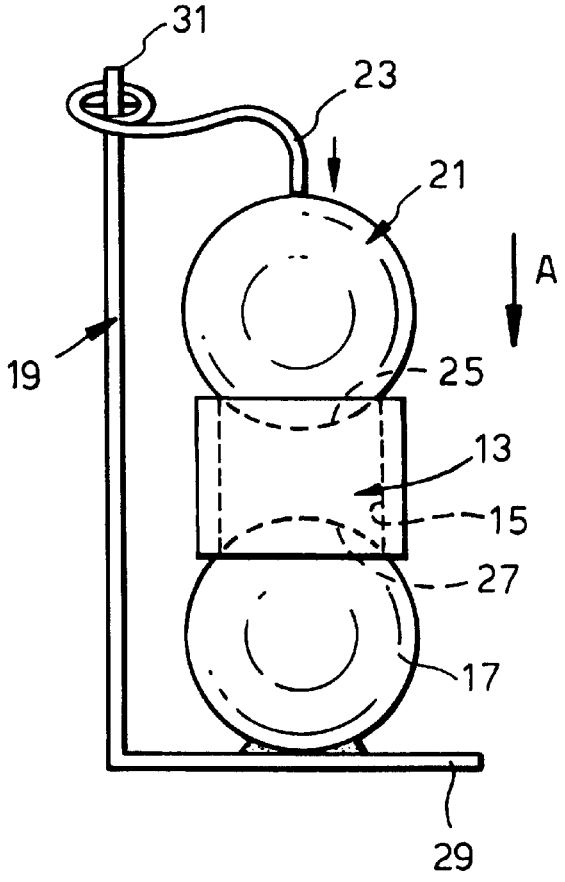
FIG. 2 shows a side elevation view of a second example.

FIG. 2 shows a bushing 13 having a bore 15. The bushing is positioned on a ball 17 that is welded to a frame 19. A second ball 21 rests on the bushing 13 at the opposite end to ball 17. The ball 21 is connected to the frame 19 by a spring 23, the spring 23 exerting a force on ball 21 in the direction indicated by arrow A to cause the bushing 13 to be firmly held in the position shown between balls 17 and 21.

A portion 25 of ball 21 extends into one end of the bore 15 and a portion 27 of ball 17 extends into the other end of bore 15. The pressure exerted by spring 23 causes the balls 21, 17 to effectively seal the bore 15, preventing liquid from entering therein.

The frame 19 is made from an electrically conductive material coated in an insulator such as a plastic material. The frame has contacts 29, 31 for allowing a current to flow from an electrical source (not shown) through the core conductive material in the frame. The spring 23 preferably has a conductive core coated in a non-conductive material for allowing current to flow through the spring and into the ball 21. Balls 21 and 17 are preferably made from titanium, so that they can conduct current into the bushing 13 without themselves becoming cadmium plated. Alternatively, the balls 17 and 21 may be made from steel coated with a nonconductive material such as plastic, the plastic being cut away at the point where the ball makes contact with the bore 15.

In use, the frame 19 holding the bushing 13 is dipped into a cadmium solution and contacts 31 and 29 are connected to an electrical source so that a current is passed through the frame 19, the current flowing through the spring 23, balls 21 and 17 and the bushing 13. The exposed surfaces of the bushing become cadmium plated, but the balls 21, 17 prevent cadmium solution from entering the bore 15 and so the bore does not become cadmium plated.

This embodiment allows numerous bushings to be plated simultaneously, as a frame can be constructed having several balls welded or otherwise fixed to the frame, and several spring loaded balls attached to the frame above or adjacent the first balls to provide several pairs of balls for holding bushings on a single frame.

Figure 3:
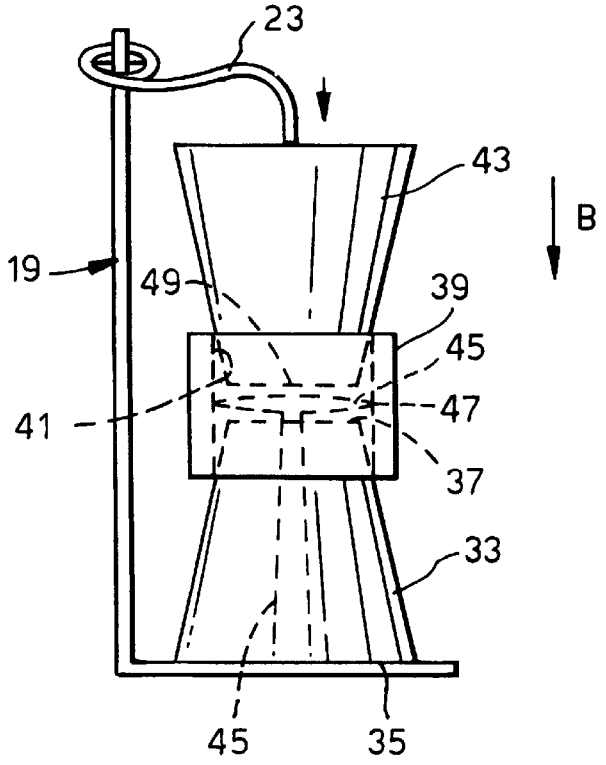
FIG. 3 shows a side elevation view of a third example.

FIG. 3 shows part of a frame 19, the frame being constructed as described with reference to FIG. 2. A frustum 33 is fixed to the frame 19 as shown, so that the larger end 35 of the frustum 33 is in contact with frame 35 and the narrow end 37 is free to receive a bushing 39 having a bore 41. A second frustum 43 is attached to frame 19 by a spring 23, the spring being similar to that described with reference to FIG. 2.

The frustums 33, 43 may be made from a conductive material which is coated in a compressible insulator, for example steel coated with rubber or a compressible plastic material. Alternatively the frustums 33, 43 may be made from a non-conductive material which is to an extent compressible, such that the frustums 33, 43 an be inserted and wedged into the bore 41 of a bushing 39, providing a seal to prevent liquid from entering the bore 41.

The frustum 33 has an electrically conductive wire or spring 45 running through it for electronically connecting the inner annular surface 47 of the bushing to the frame 19.

In use, the bushing is placed on frustum 33 and manually pushed so that the end 37 of frustum 33 extends as far as possible into the bore 41. The second frustum 43 is then positioned so that the narrow end 49 of frustum 43 extends as far as possible into the other end of the bore 41, as shown in FIG. 3. Frustum 43 is kept firmly in position by spring 23, which exerts a force in the direction indicated by arrow B.

The frame 19 is connected to an electrical source as described with reference to FIG. 2 and the frame 19 is then placed in a bath of cadmium solution. An electrical current is passed through the frame, the current flowing through the spring or wire 45 to the bushing 39. The bushing 39 becomes plated in cadmium, except for the bore, as the cadmium solution is prevented from entering the bore due to the frustums 33, 43.

In this embodiment, spring 23 does not need to conduct current. An advantage of this embodiment is that bushings of various bore sizes may be accommodated on one size of frustum. This reduces the need for frustums of various sizes, and so is more cost effective. The frame 19 may comprise several pairs of frustums attached thereto as shown.

Figure 4:
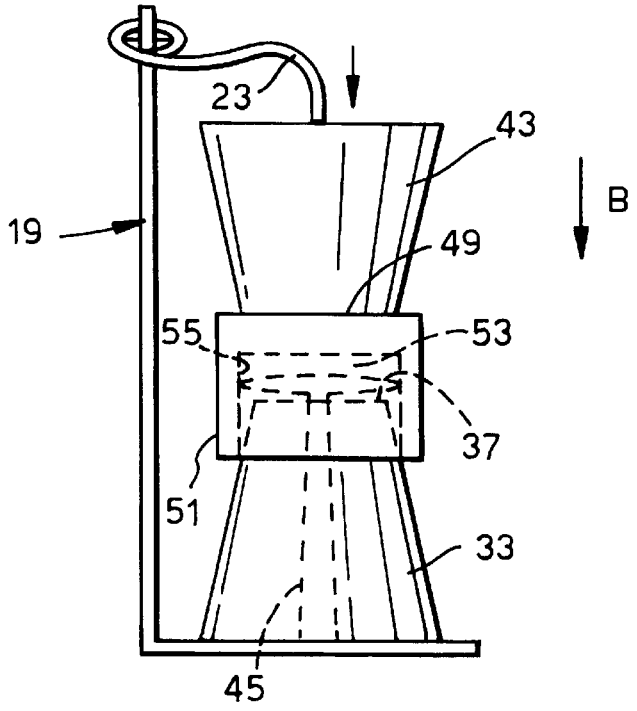
FIG. 4 shows a side elevation view of a fourth example.

FIG. 4 shows the same apparatus as that of FIG. 3, except the article 51 to be cadmium plated has a recess 53 rather than a bore extending through the article. The article 51 is positioned on frustum 33 such that the narrow end 37 of frustum 33 extends as far as possible into the recess 53. The electronically conductive spring or wire 45 extends from the frame 19 through the frustum 33 to make contact with the surface 55 of the recess 53. Frustum 43 is then positioned adjacent the article 51 as shown, and the spring 23 exerts a force in the direction shown by arrow B to clamp the article 51 in position during the cadmium plating process which is as described with reference to FIG. 3.

Figure 5:
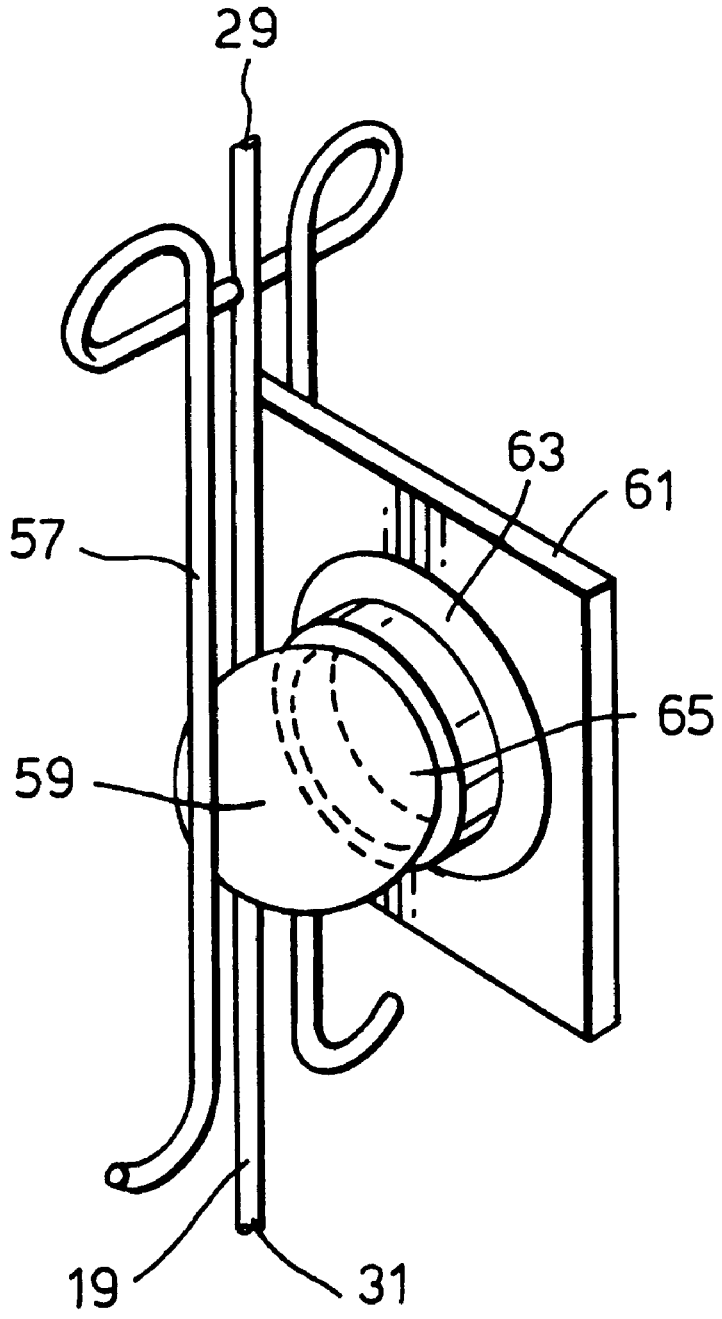
FIG. 5 shows an isometric view of a fifth example.

FIG. 5 shows part of a frame 19, the frame being constructed as described with reference to FIG. 2. A resilient member 57 is connected to the frame, and a ball 59 is attached to the resilient member 57. A plate 61 is attached to the frame 19. The plate 61 is incompressible and preferably coated with a non-conductive material, except for an electrically conductive portion for making contact with an article pressed against the plate. Alternatively, the plate could be made from titanium. In use, a flat topped bushing 63 is placed against the plate 61 such that the flat end of the bushing 63 makes contact with the electrically conductive portion of the plate 61. The ball 59 is placed so that it extends into the bore 65 of the bushing 63 at the end remote from the flat end, and the ball 59 is tightly held in position by the resilient member 57, effectively sealing the bore 65 of the bushing 63 and preventing liquid from entering therein during plating. The ball 59 is preferably made from titanium, or alternatively steel coated with a non-conductive material except at the locations where the ball 59 makes contact with the bore 65. The resilient member 57 has a conductive core coated in a non-conductive material, for allowing current to flow from the frame 19, through the resilient member 57, and into the ball 59. The flat top will not become plated if the plate 61 is in close contact with the whole of the top, thereby preventing plating liquid from touching the top of the bushing.

Articles having a bore and flat top may be treated in this manner, as well as articles having a recess and flat top. The plate may also be used in this manner for masking regions of a substantially planar surface of an article.

It will be recognised that various modifications of this invention may now suggest themselves to a person skilled in the art, without departing from the essence of this invention.

What is claimed is:

1. A frame having a plurality of sealing members positioned thereon, the frame being capable of conducting an electrical current between sealing members, each sealing member being adapted to be in close contact with part of an article to be located thereon and to thereby substantially prevent fluid from touching that part of the article or entering into a bore or recess of the article, each sealing member further being adapted to conduct current between the frame and the article.

2. A frame as claimed in claim 1 wherein a force exerting device is provided on the frame for exerting a force on the article to hold the article firmly in close contact with a sealing member.

3. A frame as claimed in claim 2 wherein the force exerting device comprises a resiliently biased member.

4. A frame as claimed in claim 1 wherein the sealing members are substantially planar.

5. A frame as claimed in claim 1 wherein the sealing members are adapted to extend at least part way into a recess or bore of the article to be located thereon.

6. A frame as claimed in claim 1 wherein the force exerting device is adapted to hold the article between two sealing members.

7. A frame as claimed in claim 1 wherein the force exerting device is adapted to hold the article between the force exerting device and a sealing member.

8. A frame as claimed in claim 1 wherein the sealing members are formed from a compressible, non-conductive material.

9. A frame as claimed in claim 1 wherein the sealing members comprise an electrically conductive core substantially encased in an electrical insulator material.

10. A frame as claimed in claim 1 wherein an electrically conductive member extends from the frame through a sealing member such that the electrically conductive member is capable of forming an electrical contact between an article located on the sealing member, and the frame.

11. A frame as claimed in claim 1 wherein the sealing members are formed from titanium.

12. A frame as claimed in claim 1 wherein the frame is coated in a non-conductive material to prevent the frame from becoming metal plated when a current is applied to the frame and it is exposed to a metallic solution.

13. A frame having a plurality of sealing members positioned thereon, the frame being capable of conducting an electrical current between sealing members, each sealing member being adapted to extend at least part way into a recess or bore of an article to be located thereon and to substantially prevent fluid from entering into the bore or recess of the article, each sealing member further being adapted to conduct current between the frame and the article.

* * * * *